US006316649B1

(12) United States Patent
Cermak et al.

(10) Patent No.: US 6,316,649 B1
(45) Date of Patent: Nov. 13, 2001

(54) BIODEGRADABLE OLEIC ESTOLIDE ESTER HAVING SATURATED FATTY ACID END GROUP USEFUL AS LUBRICANT BASE STOCK

(75) Inventors: Steven C. Cermak, Galesburg; Terry A. Isbell, Elmwood, both of IL (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 0 days.

(21) Appl. No.: 09/490,360

(22) Filed: Jan. 24, 2000

Related U.S. Application Data

(63) Continuation-in-part of application No. 09/191,907, filed on Nov. 13, 1998, now Pat. No. 6,018,063.

(51) Int. Cl.[7] ..... C07C 59/00

(52) U.S. Cl. ..... 554/219; 554/213; 508/485; 252/47.7

(58) Field of Search ..... 554/213, 219; 508/460, 463, 485

(56) References Cited

U.S. PATENT DOCUMENTS

| | | | |
|---|---|---|---|
| 4,428,850 | 1/1984 | Zoleski et al. | 252/42.7 |
| 4,567,037 | 1/1986 | Ciaudelli | 121/59 |
| 4,639,369 | 1/1987 | Ciaudelli | 424/59 |
| 5,204,375 | 4/1993 | Kusakawa et al. | 514/784 |
| 5,380,894 | 1/1995 | Burg et al. | 554/219 |
| 5,658,863 | 8/1997 | Duncan et al. | 508/485 |
| 6,018,063 * | 1/2000 | Isbell et al. | 554/213 |

OTHER PUBLICATIONS

Terry A. Isbell et al. "Acid–Catalyzed Condensation of Oleic Acid into Estolides and Polyestolides" *JAOCS*, vol. 71, No. 2 (Feb. 1994) pp. 169–174.

Terry A. Isbell et al. "Characterization of Estolides Produced from the Acid–Catalyzed Condensation of Oleic Acid" *JAOCS*, vol. 71, No. 4 (Apr. 1994) pp. 379–383.

Selim M. Erhan et al. "Estolide Production With Modified Clay Catalysts and Process Conditions" *JAOCS*, vol. 74, No. 3 (1997) pp. 249–254.

Terry A. Isbell et al. "Optimization of the Sulfuric Acid–Catalyzed Estolide Synthesis from Oleic Acid" *JAOCS*, vol. 74 No. 4 (1997) pp. 473–476.

T. Kusakawa et al. "Biodegradable estolide–hindered alcohol ester composition for lubricating oil", SciFindersearch on Mar. 20, 2000.

* cited by examiner

*Primary Examiner*—Deborah D. Carr
(74) *Attorney, Agent, or Firm*—M. Howard Silverstein; Curtis P. Ribando; John D. Fado

(57) ABSTRACT

Esters of estolides derived from oleic acids and C-6 to C-14 saturated fatty acids are characterized by superior properties for use as lubricant base stocks. These estolides may also be used as lubricants without the need for fortifying additives normally required to improve the lubricating properties of base stocks.

27 Claims, No Drawings

BIODEGRADABLE OLEIC ESTOLIDE ESTER HAVING SATURATED FATTY ACID END GROUP USEFUL AS LUBRICANT BASE STOCK

This application is a Continuation-in-Part of U.S. Ser. No. 09/191,907 filed Nov. 13, 1998, now U.S. Pat. No. 6,018,063, issued Jan. 25, 2000.

BACKGROUND OF THE INVENTION

1. Field of the Invention

This invention relates to esters of oleic acid estolides having saturated fatty acid and groups, and their use as biodegradable base stocks and lubricants.

2. Description of the Prior Art

Synthetic esters, such as polyol esters and adipates, low viscosity poly alpha olefins (PAO), such as PAO 2, vegetable oils, especially Canola oil and oleates are used industrially as biodegradable basestocks to formulate lubricants. Lubricants usually contain 80–100% wt. basestock and 0–20% wt. additives to tailor their viscometric properties, low temperature behavior, oxidative stability, corrosion protection, demulsibility and water rejection, friction coefficients, lubricities, wear protection, air release, color and other properties. Biodegradability cannot be improved by using additives.

In the recent prior art, a fair amount of attention has been given to estolides as having potential for base stocks and lubricants. An estolide is a unique oligomeric fatty acid that contains secondary ester linkages on the alkyl backbone of the molecule.

Estolides have typically been synthesized by the homopolymerization of castor oil fatty acids [Modak et al., *JAOCS* 42:428 (1965); Neissner et al., *Fette Seifen Anstrichm* 82:183 (1980)] or 12-hydroxystearic acid [Raynor et al., *J. Chromatogr.* 505:179 (1990); Delafield et al., *J. Bacteriol.* 90:1455 (1965) under thermal or acid catalyzed conditions. Yamaguchi et al., [Japanese Patent 213,387, (1990)] recently described a process for enzymatic production of estolides from hydroxy fatty acids (particularly ricinoleic acid) present in castor oil using lipase. Estolides derived from these sources are composed of esters at the 12 carbon of the fatty acids and have a residual hydroxyl group on the estolide backbone. In addition, the level of unsaturation in the produced egtolides (expressed through e.g. iodine value) is not significantly lower than that in raw materials, i.e., hydroxy fatty acids.

Erhan et al. [JAOCS, 70:461 (1993)], reported the production of estolides from unsaturated fatty acids using a high temperature and pressure condensation over clay catalysts. Conversion of the fatty acid double bond into an ester functionality is a strikingly different method than the hydroxy esterification process.

The parent application of Isbell et al., U.S. Ser. No. 09/191,907, now U.S. Pat. No. 6,018,063, issued Jan. 25, 2000, reported a novel class of estolide compounds derived from oleic acids and having superior properties for use as lubricant base stocks. These compounds are characterized by Formula I, infra, wherein the "capping" fatty acid moiety $R_3$ is typically oleic or stearic acid. Studies with these estolides revealed that the stearic acid has the effect of adversely raising the pour point of the lubricant; and, generally, the greater percentage of stearic acid as the capping moiety, the higher the pour point temperature.

SUMMARY OF THE INVENTION

We have now discovered a family of novel estolide compounds derived from oleic acids and certain saturated organic acids in the range of C-6 to C-14 which have unexpectedly low (superior) pour point temperatures. The discovery that estolides having acceptable pour point temperatures could be derived from an oleic/saturated fatty acid blend is particularly surprising from the previous findings of Isbell et al., U.S. Pat. No. 6,018,063. These estolide compounds are characterized by superior properties for use as lubricant base stocks. These estolides may also be used as lubricants without the need for fortifying additives normally required to improve the lubricating properties of base stocks.

The estolide esters of this invention are generally characterized by Formula I:

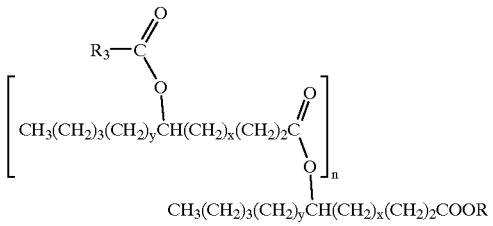

wherein x and y are each equal to 1 or greater than 1;

wherein x+y=10;

wherein n is 0, 1, or greater than 1;

wherein R is $CHR_1,R_2$;

wherein $R_1$ and $R_2$ are independently selected from hydrogen and C-1 to C-36 hydrocarbon which may be saturated or unsaturated, branched or straight chain, and substituted or unsubstituted;

wherein $R_3$ is a residual fragment of oleic, myristic, lauric, decanoic, octanoic, or caproic acid; and wherein the predominant species of secondary ester linkage is at the 9 or 10 position; that is, wherein x=5 or 6 and y=5 or 4, respectively.

In accordance with this discovery, it is an object of this invention to provide novel estolide compounds having utility as lubricant base stocks and also as lubricants without the necessity for inclusion of conventional additives.

It is a further object of this invention to provide a family of estolides which are biodegradable and which have superior oxidative stability, low temperature and viscometric properties.

Other objects and advantages of this invention will become readily apparent from the ensuing description.

DETAILED DESCRIPTION

For purposes of this invention, the term "monoestolides" is used generically to refer to the acid form of compounds having the structure of Formula I, wherein n=0. The term "polyestolides" is used herein to refer to the acid form of compounds having the structure of Formula I, wherein n is greater than 0. The terms "ester", "estolide ester" and the like are generally used herein to refer to products produced by esterifying the residual fatty acid (attachment of the R group in Formula I) on the estolide or estolide mixtures as described below. Of course, estolides are esters resulting from secondary ester linkages between fatty acid chains, and every effort will be made herein to distinguish the actual estolide from the ester thereof.

The production of monoestolides and polyestolides by various routes is fully described in Isbell et al. (I) [JAOCS, Vol. 71, No. 1, pp. 169–174 (February 1994)], Erhan et al. [JAOCS, Vol. 74, No. 3, pp. 249–254 (1997)], and Isbell et al. (II) [JAOCS, Vol. 74, No. 4, pp. 473–476 (1997)], all of which are incorporated herein by reference. Though not required, it is preferred for purposes of quality control that the olefinic component of the starting material be as pure in oleic acid as practical. Isbell et al. (III) [JAOCS, Vol. 71, No. 1, pp. 379–383 (April 1994)], characterize the oleic estolides produced by acid catalysis as being a mixture of monoestolides and polyestolide oligomers up to eight or more fatty acid molecules interesterified through secondary ester linkages on the alkyl backbone. This publication also teaches that the positions of these secondary ester linkages were centered around the original C-9 double bond position, with linkages actually ranging from positions c-5 to C-13 and most abundantly at the C-9 and C-10 positions in approximately equal amounts. Likewise, the remaining unsaturation on the terminal fatty acid was distributed along the fatty acid backbone, presumably also from C-5 to C-13. The linkages of the estolides of this invention would have the same or approximately the same distribution of linkages reported by Isbell et al., 1994. Therefore, it is to be understood that Formula I, supra, is a generalization of the estolide backbone structure of the compounds contemplated herein, and that the formula is intended to encompass normal distributions of reaction products resulting from the various reaction procedures referenced above. Applicants believe that the superior properties of the subject estolide esters are dictated not so much by positions of the linkage and the site of unsaturation, but more by the combination of the degree of oligomerization, decrease in level of unsaturation, the virtual absence of hydroxyl functionalities on the estolide backbone, the nature of the specific ester moiety (R) and selecting the capping fatty acid $R_3$ from the group of oleic, myristic, lauric, decanoic, octanoic, and caproic acids, and mixtures thereof. However, the process inherently introduces a distribution of secondary linkage positions in the estolide, which in general, affects low temperature and viscometric behavior very favorably. Minor components other than oleic acid, such as linoleic acid or stearic acid may lead to variations in the basic estolide structure shown in Formula I.

The advantages of this invention are achieved by incorporating into the starting material an appropriate source of the aforementioned C-6 to C-14 saturated fatty acids. The source may be any isolated, saturated fatty acid or blends of individual fatty acids. Alternatively, the source may be any natural fat or oil having a high percentage of these acids, such as coconut oil, palm kernel oil, cuphea oil, and certain hydrogenated tallow or lard cuts. For example, the typical fatty acid composition of coconut oil is 49% lauric (C-12), 19% myristic (C-14), 9% palmitic (C-16), 7% stearic (C-18), 6.5% octanoic (C-8), 6% decanoic (C-10) and 3% oleic. Typically, the saturated component or components will be blended with the oleic acid starting material in an oleic:saturate ratio in the range of about 1:4 to about 4:1, with a preferred ratio in the range of 1:3 to 3:1, and more preferably in the range of about 2:1 to about 3:1. For purposes of the invention, any mixture of estolide products resulting from a mixture of fatty acids in the starting material as defined above should have at least about 45% of the C-6 to C-14 fatty acid as the capping group ($R_3$). More preferably, the percentage is within the range of 50–85%.

The oleic acid estolides for use in making the esters of this invention can be recovered by any conventional procedure. Typically, the preponderance of low boiling monomer fraction (unsaturated fatty acids and saturated fatty acids) are removed.

The oleic estolides are esterified by normal procedures, such as acid-catalyzed reduction with an appropriate alcohol. In the preferred embodiment of the invention, $R_1$ and $R_2$ are not both hydrogen, and more preferably, neither $R_1$ nor $R_2$ is hydrogen. That is, it is preferred that the reactant alcohol be branched. In the most preferred embodiment of the invention, the oleic estolide esters are selected from the group of isopropyl ester, 2-ethylhexyl ester and isostearyl ester. It is also preferred that the average value of n in Formula I is greater than about 0.5 and more preferably greater than about 1.0.

Particularly contemplated within the scope of the invention are those esters which are characterized by: a viscosity at 40° C. of at least 20 cSt and preferably at least about 32 cSt; a viscosity at 100° C. of at least 5 cSt and preferably at least about 8 cSt; a viscosity index of at least 150; a pour point of less than −21° C. and preferably at least −30° C.; a volatility of less than 10% at 175° C.; an insignificant (<10%) oxypolymerization in 30 min at 150° C. in the micro oxidation test [Cvitkovic et al., *ASLE Trans.* 22:395 (1979); Asadauskas, PhD Thesis, Pennsylvania State Univ. p.88 (1997)]; and a biodegradabilty in the OECD Test greater than 70%. Determination of these properties by conventional test procedures are routine. Therefore, identification of oleic estolide esters within the scope of Formula I would be fully within the skill of the ordinary person in the art.

As previously indicated and as demonstrated in the Examples, below, the oleic estolide esters of this invention have superior properties which render them useful as base stocks for biodegradable lubricant applications, such as crankcase oils, hydraulic fluids, drilling fluids, two-cycle engine oils and the like. Certain of these esters meet or exceed many, if not all, specifications for some lubricant end-use applications without the inclusion of conventional additives.

When used as a base stock, the subject esters can be admixed with an effective amount of other lubricating agents such as mineral or vegetable oils, other estolides, poly alpha olefins, polyol esters, oleates, diesters, and other natural or synthetic fluids.

In the preparation of lubricants, any of a variety of conventional lubricant additives may optionally be incorporated into the base stock in an effective amount. Illustrative of these additives are detergents, antiwear agents, antioxidants, viscosity index improvers, pour point depressants, corrosion protectors, friction coefficient modifiers, colorants, antifoam agents, demulsifiers and the like.

The expression "effective amount" as used herein is defined to mean any amount that produces a measurable effect for the intended purpose. For example, an effective amount of an antiwear agent used in a lubricant composition is an amount that reduces wear in a machine by a measurable amount as compared with a control composition that does not include the agent.

THE EXAMPLES

Estolides prepared in accordance with the invention were evaluated against the properties of common basestocks reported in Table A.

Viscometric properties determine the flow characteristics of the lubricants, their film thickness, and their ability to maintain a lubricating film under varying temperatures. In the lubricant industry these properties are determined by measuring kinematic viscosities using Cannon-Fenske viscometers and then assigned to viscosity grades. ISO 32 and ISO 46 grades are the most popular.

Advantages of the estolides of the invention are their high viscosity index (VI) and viscosity grade of ISO 46. This compares to viscometric properties of oleates and vegetable oils. These estolides would not need thickeners which are necessary for tridecyl adipate or PAO 2. Presence of polymer based thickeners or viscosity modifiers may cause shear stability problems in formulated lubricants.

Low temperature properties are important for lubricant pumpability, filterability, fluidity as well as cold cranking and startup. Pour point is the most common indicator of the low temperature behavior. Basestocks derived from vegetable oils usually cannot remain liquid in the cold storage test for more than 1 day, therefore, in addition to the pour point, the cold storage test is being developed by ASTM D02 to assess lubricants suitability. The estolides of the invention have significantly better low temperature properties than trioleates, vegetable oils or polyol esters of higher viscosities.

Oxidative stability defines durability of a lubricant and its ability to maintain functional properties during its use. Vegetable oil and oleate based lubricants usually suffer from poor oxidative stability. Oxidative stabilities of the estolides described by the invention are comparable to these of fully saturated materials such as PAOs, polyol esters and adipates. Vegetable oils and most fluids derived from them are clearly inferior to the estolides.

In general, the estolides of the invention are expected to have advantages over vegetable oils and oleates in their oxidative stability and low temperature properties, over low viscosity PAOs; and they are expected to have advantages over adipates, in volatility, viscometric properties and biodegradability.

Example 1

Preparation of 2-Ethylhexyl Oleic Coconut Estolides (One Step)

To commercial grade oleic acid (≧70% oleic) and coconut fatty acids in an evacuated 500 mL 3-neck water jacket flask was added perchloric acid in the proportions shown in Table 1. The temperature was maintained at 60° C. for 24 hrs and stirred with an overhead stirrer at approximately 300 rpm. After breaking the vacuum with nitrogen, 2-ethylhexanol (1.2 mole equivalents) was added to the flask over 2 min and then the vacuum was restored. After mixing for 2 hrs at 60° C., the mixture was cooled. KOH (1.2 mole equivalents per $H^+$equivalents) in ethanol/water (9:1) was added to the solution and the mixture was stirred for 20 min. The product was filtered through a number 1 Whatman filter. The product was recovered by vacuum distillation at 0.1–0.5 torr at 100 –115° C. to remove the excess 2-ethylhexyl alcohol or at 0.1–0.5 torr at 180–190° C. to remove the monomer. The physical properties for these materials were collected and recorded in Table 1.

Example 2

Preparation of 2-Ethylhexyl Oleic Lauric Estolides (Two Steps)

To commercial grade oleic acid (≧70% oleic) and lauric acid in a 500 mL 3-neck water jacket flask was added perchloric acid in the proportions shown in Table 2. The temperature was maintained at either 450 or 55° C., depending on the run, for 24 hrs and stirred with an overhead stirrer, approximately 300 rpm. After 24 hrs the reaction was cooled to room temperature and 0.5 M $Na_2HPO_4$ (425 mL) was added. The solution was transferred to a sedaratory funnel and a mixture of ethyl acetate:hexane, 2:1, (200 mL) was added to the mixture. The organic layer was separated and washed with pH 5 buffer, $NaH_2PO_4$, (2×100 mL) followed by brine (2×50 mL). The organic layer was collected and dried over sodium sulfate. Product was recovered by removing the solvent via rotary evaporation followed by vacuum distillation at 0.1–0.5 torr at 180–190° C. The physical properties for these free acid estolides were collected and recorded in Table 2.

The distilled oleic lauric estolide (80 g) was placed in a 1 L round bottom with a 0.5 M solution of $BF_3$ and 2-ethylhexanol (240 mL, 1.2 mole equivalents based on 2-ethylhexyl alcohol). The solution was heated to 60° C. while being magnetically stirred. After about 3–4 hr, when complete by HPLC, the reaction was cooled to rt and water (100 mL ) was added. The oil was separated and washed with brine (100 mL) followed by drying Qver sodium sulfate. The product was recovered by vacuum distillation at 0.1–0.5 torr at 100–115° C. to remove 2-ethylhexyl alcohol. The physical properties for these 2-ethylhexyl egtolides were collected and recorded in Table 2.

Example 3

Varying Acid Amounts to Yield 2-Ethylhexyl Oleic Lauric Estolides (Two Steps)

Commercial grade of oleic acid (≧70% oleic) and lauric acid were combined under similar conditions as in Example 2, except all reactions were conducted at 45° C. The amounts of perchloric acid were varied within a mole equivalent range from 0.4–0.01 as reported in Table 3. Recovery and purification were carried out under conditions identical to Example 2. The physical properties were examined (Table 3) and the estolides were esterified to the 2-ethylhexyl ester estolides as in Example 2. The physical properties of the 2-ethylhexyl ester estolides were examined (Table 3).

Example 4

Substituting Other Short Chain Fatty Acids for Lauric Acid

The procedure of Example 2 was repeated, substituting each caproic, octanoic, decanoic, myristic, and stearic fatty acids for lauric acid. The resultant estolides were all evaluated for pour point, cloud point, Gardner color, estolide number, iodide value, viscosity index, and viscosity at 40° C. and 100° C. These estolides were then esterified to the corresponding 2-ethylhexyl ester under the same conditions as in Example 2. The 2-ethylhexyl esters of the complex estolides were evaluated for the same properties as above. The results are reported in Table 2.

It is understood that foregoing detailed description is given merely by way of illustration and that modifications and variations may be made therein without departing from the spirit and scope of the invention.

TABLE A

Properties of Common Basestocks

| Properties, units (test method) | TMP trioleate | Canola oil | PAO 2 | polyol ester | tridecyl adipate |
|---|---|---|---|---|---|
| Modified Sturm test, % in 28 days (OECD 301 B) | 70% | >85% | >70% | <40% | <30% |
| Viscosity at 40° C. (ASTM D 445) | 49 | 38.5 | 5.55 | 78.3 | 27 |

TABLE A-continued

| Properties, units (test method) | Properties of Common Basestocks | | | | |
|---|---|---|---|---|---|
| | TMP trioleate | Canola oil | PAO 2 | polyol ester | tridecyl adipate |
| VI(ASTM D 2270) | 190 | 207 | 147 | 135 | |
| Pour Point, ° C. (ASTM D 97) | −24 | −18 | −72 | −21 | −54 |
| Cold Storage at −25° C., days | <1 | <1 | 7+ | <1 | 7+ |

TABLE 1

| | | | | | | With monomer still present | | | | | |
|---|---|---|---|---|---|---|---|---|---|---|---|
| Ex | Name | Name | Ratio | $HClO_4$ eq | 2-EH eq | Estolide wt | Pour pt ° C. | Cloud pt ° C. | Vis @ 40 ° C. | Vis Index | Gardner Color |
| IA | oleic | coconut | 1:1 | 0.05 | 1.2 | 200.60 | −21 | −13 | 21.3 | 183 | 10 |
| IB | oleic | coconut | 2:1 | 0.05 | 1.2 | — | −33 | −26 | 52.2 | 169 | 11 |
| IC | oleic | coconut | 1:2 | 0.05 | 1.2 | 209.70 | −18 | 16 | 21.3 | 175 | 10 |
| ID | oleic | coconut | 3:1 | 0.05 | 1.2 | 113.8 | −24 | −21 | 58.8 | TBD | 11 |
| IE | oleic | coconut | 1:3 | 0.05 | 1.2 | 233.20 | 18 | 23 | 28.8 | 165 | 11 |

| | | | | With monomer removed | | | | | | | |
|---|---|---|---|---|---|---|---|---|---|---|---|
| Ex | Name | Name | Ratio | Esto wt | Mono wt | GC EN | Pour pt ° C. | Cloud pt ° C. | Vis @ 40 ° C. | Vis Index | Gardner Color |
| IA | oleic | coconut | 1:1 | 64.80 | 53.1 | 1.91 | −24 | −25 | 58.4 | 175 | 12 |
| IB | oleic | coconut | 2:1 | TBD | TBD | 1.94 | −33 | −33 | 92.8 | 170 | 12 |
| IC | oleic | coconut | 1:2 | 41.10 | 43.2 | 1.46 | −27 | −22 | 61.1 | 164 | 13 |
| ID | oleic | coconut | 3:1 | 71.60 | 44.5 | 1.96 | −33 | −32 | 86.3 | 232 | 12 |
| IE | oleic | coconut | 1:3 | 71.30 | 70.8 | 1.49 | −21 | −18 | 149.5 | 138 | 17 |

Ex = Example
TBD = To Be Determined
eq = Equivalant
Vis = Viscosity
EN = Estolide Number
pt = Point

TABLE 2

| | | | | | | Estolide as the free acid | | | | | | |
|---|---|---|---|---|---|---|---|---|---|---|---|---|
| Ex | Name | Name | Ratio | $HClO_4$ eg | ° C. | Estolide Mass | % | Pour pt ° C. | Cloud pt ° C. | Vis @ 40 ° C. | Vis Index | Gardner Color |
| 2A | oleic | Caproic | 2:1 | 0.4 | 45 | 68.70 | — | −24 | −27 | 515.5 | 122 | 9 |
| 2B | oleic | Caproic | 2:1 | 0.4 | 55 | 62.30 | — | −21 | −17 | 411.2 | 148 | 11 |
| 2C | oleic | Octanoic | 2:1 | 0.4 | 45 | 73.80 | — | −24 | −24 | 389.1 | 143 | 10 |
| 2D | oleic | Octanoic | 2:1 | 0.4 | 55 | 61.40 | — | −18 | −9 | 398.1 | 147 | 12 |
| 2E | oleic | Decanoic | 2:1 | 0.4 | 45 | 84.50 | — | −21 | —[1] | 342.0 | 142 | 18 |
| 2F | oleic | Decanoic | 2:1 | 0.4 | 55 | 73.60 | — | −21 | —[1] | 336.9 | 145 | 18 |
| 2G | oleic | Myristic | 2:1 | 0.4 | 45 | 89.80 | — | −18 | −6 | 282.3 | 146 | 6 |
| 2H | oleic | Myristic | 2:1 | 0.4 | 55 | 76.60 | — | −9 | 7 | 290.5 | 140 | 10 |
| 2I | oleic | Lauric | 2:1 | 0.4 | 45 | 86.30 | — | −25 | −27 | 262.6 | 145 | 7 |
| 2J | oleic | Lauric | 2:1 | 0.4 | 55 | 81.50 | — | −16 | −18 | 262.4 | 143 | 11 |
| 2K | oleic | Stearic | 2:1 | 0.4 | 45 | 73.30 | — | −9 | 6 | 296.5 | 143 | 11 |
| 2L | oleic | Stearic | 2:1 | 0.4 | 55 | 66.90 | — | 3 | 19 | 296.6 | 141 | 11 |

| | | | | | | Estolide as the 2-ethyl hexyl ester | | | | | | |
|---|---|---|---|---|---|---|---|---|---|---|---|---|
| | | | | | Ester mass | % | EN | Pour pt ° C. | Cloud pt ° C. | Vis @ 40 ° C. | Vis Index | Gardner Color |
| 2A | oleic | Caproic | 2:1 | | TBD | — | TBD | TBD | TBD | TBD | TBD | TBD |

TABLE 2-continued

| | | | | | | | | | | | |
|---|---|---|---|---|---|---|---|---|---|---|---|
| 2B | oleic | Caproic | 2:1 | TBD | — | TBD | TBD | TBD | TBD | TBD | TBD |
| 2C | oleic | Octanoic | 2:1 | TBD | — | 3.33 | TBD | TBD | TBD | TBD | TBD |
| 2D | oleic | Octanoic | 2:1 | TBD | — | 2.92 | TBD | TBD | TBD | TBD | TBD |
| 2E | oleic | Decanoic | 2:1 | TBD | — | 2.97 | TBD | TBD | TBD | TBD | TBD |
| 2F | oleic | Decanoic | 2:1 | TBD | — | 2.72 | TBD | TBD | TBD | TBD | TBD |
| 2G | oleic | Myristic | 2:1 | TBD | — | 2.33 | TBD | TBD | TBD | TBD | TBD |
| 2H | oleic | Myristic | 2:1 | TBD | — | 2.19 | TBD | TBD | TBD | TBD | TBD |
| 2I | oleic | Lauric | 2:1 | 78.20 | — | TBD | −36 | −32 | 73.86 | 179 | 12 |
| 2J | oleic | Lauric | 2:1 | 83.80 | — | TBD | −27 | −29 | 70.64 | 176 | 15 |
| 2K | oleic | Stearic | 2:1 | TBD | — | 2.04 | TBD | TBD | TBD | TBD | TBD |
| 2L | oleic | Stearic | 2:1 | TBD | — | 1.80 | TBD | TBD | TBD | TBD | TBD |

Ex = Example
TBD = To Be Determined
eq = Equivalent
—[1] = Solution to dark to determine
Vis = Viscosity
EN = Estolide Number
pt = Point
— = To be Calculated

TABLE 3

| Ex | Name | Name | eq | $HClO_4$ eq | ° C. | mass | Pour pt ° C. | Cloud pt ° C. | Vis @ 40 ° C. | Vis Index | Gardner Color | % |
|---|---|---|---|---|---|---|---|---|---|---|---|---|
| 3A | oleic | Lauric | 2:1 | 0.4 | 45 | TBD | −21 | −26 | 297.9 | 143 | 8 | TBD |
| 3B | oleic | Lauric | 2:1 | 0.1 | 45 | 59.10 | −27 | −25 | 178.5 | 141 | 10 | TBD |
| 3C | oleic | Lauric | 2:1 | 0.2 | 45 | 77.70 | −27 | −28 | 235.7 | 143 | 8 | TBD |
| 3D | oleic | Lauric | 2:1 | 0.01 | 45 | NR | NR | NR | NR | NR | NR | NR |
| 3E | oleic | Lauric | 2:1 | 0.05 | 45 | 76.60 | −24 | TBD | 189.8 | 143 | 12 | TBD |

| Ex | Name | Name | eq | Estolide Ester mass | GC EN | Pour pt ° C. | Cloud pt ° C. | Vis @ 40 ° C. | Vis Index | Gardner Color |
|---|---|---|---|---|---|---|---|---|---|---|
| 3A | oleic | Lauric | 2:1 | 68.10 | 2.23 | −33 | −30 | 89.5 | 169 | 9 |
| 3B | oleic | Lauric | 2:1 | 80.60 | 1.28 | −36 | −33 | 52.2 | 176 | 11 |
| 3C | oleic | Lauric | 2:1 | 69.80 | 1.85 | −27 | −32 | 69.6 | 183 | 10 |
| 3D | oleic | Lauric | 2:1 | NR | NR | NR | NR | NR | NR | NR |
| 3E | oleic | Lauric | 2:1 | TBD | TBD | TBD | TBD | TBD | TBD | TBD |

Ex = Example
TBD = To Be Determined
NR = No Reaction
eq = Equivalant
Vis = Viscosity
EN = Estolide Number
pt = Point

We claim:

1. An estolide compound of the Formula:

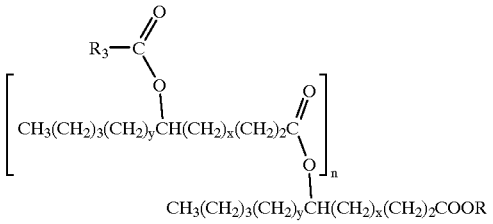

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C-1 to C-36 hydrocarbon which may be saturated or unsaturated, branched or straight chain, and substituted or unsubstituted;

wherein $R_3$ is a residual fragment of myristic, lauric, decanoic, octanoic, or caproic acid; and wherein the predominant species of secondary ester linkage is at the 9 or 10 position; that is, wherein x=5 or 6 and y=5 or 4, respectively.

2. The estolide compound of claim 1, wherein at least one of $R_1$ and $R_2$ is a C-1 to C-36 hydrocarbon.

3. The estolide compound of claim 1, wherein both $R_1$ and $R_2$ are C-1 to C-36 hydrocarbons.

4. The estolide compound of claim 1, wherein R is selected from the group of methyl, butyl, isopropyl, 2-ethylhexyl, and isostearyl.

5. The estolide compound of claim 1, wherein R is 2-ethylhexyl.

6. The estolide compound of claim 1, wherein $R_3$ is a residual fragment of lauric acid.

7. A mixture of estolide compounds of the Formula;

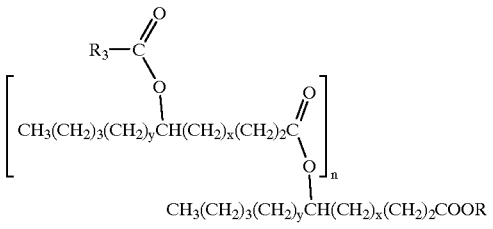

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C-1 to C-36 hydrocarbon which may be saturated or unsaturated, branched or straight chain, and substituted or unsubstituted;

wherein $R_3$ is a residual fragment of oleic, myristic, lauric, decanoic, octanoic, or caproic acid;

wherein the predominant species of secondary ester linkage is at the 9 or 10 position; that is, wherein x=5 or 6 and y=5 or 4, respectively; and wherein each of x, y, R, $R_3$ and the value of n are independently selected for each of the estolide compounds within the mixture and $R_3$ is represented in said mixture by at least two of said residual fragments.

8. The mixture of claim 7, wherein the predominant $R_3$ moiety is a residual fragment of lauric acid.

9. The mixture of claim 8, wherein the $R_3$ moieties also include residual fragments of myristic, decanoic, octanoic, caproic and oleic acids.

10. The mixture of claim 7, wherein the $R_3$ moieties are represented by the residual fragments of the fatty acids derived from coconut oil.

11. The mixture of claim 7, wherein the $R_3$ moieties are represented by the residual fragments of the fatty acids derived from palm kernel oil.

12. The mixture of claim 7, wherein the $R_3$ moieties are represented by the residual fragments of the fatty acids derived from cuphea oil.

13. The mixture of claim 7, wherein $R_3$ for at least about 45% of the estolide compounds is a residual fragment of myristic, lauric, decanoic, octanoic, or caproic acid.

14. The mixture of claim 7, wherein $R_3$ for 50–85% of the estolide compounds is a residual fragment of myristic, lauric, decanoic, octanoic, or caproic acid.

15. The mixture of claim 8, wherein R is 2-ethylhexyl.

16. A lubricant composition comprising:

(1) an estolide compound of the Formula:

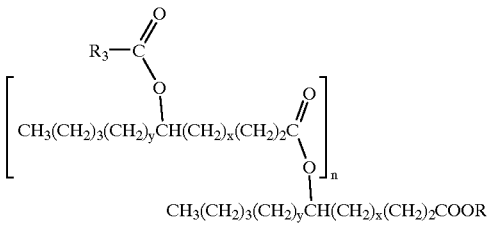

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C-1 to C-36 hydrocarbon which may be saturated or unsaturated, branched or straight chain, and substituted or unsubstituted;

wherein $R_3$ is a residual fragment of myristic, lauric, decanoic, octanoic, or caproic acid; and wherein the predominant species of secondary ester linkage is at the 9 or 10 position; that is, wherein x=5 or 6 and y=5 or 4, respectively; and (2) an effective amount of a lubricating agent.

17. The lubricant composition of claim 16, wherein said lubricating agent is selected from the group consisting of mineral oil, vegetable oil, estolide other than that defined by Formula I, poly alpha olefin, polyol ester, oleate, and diester.

18. The lubricant composition of claim 16 and further comprising an effective amount of a lubricant additive selected from the group consisting of detergent, antiwear agent, antioxidant, viscosity index Improver, pour point depressant, corrosion protector, friction coefficient modifier, colorants, antifoam agents and demulsifiers.

19. A lubricant composition comprising:

(1) a mixture of estolide compounds of the Formula:

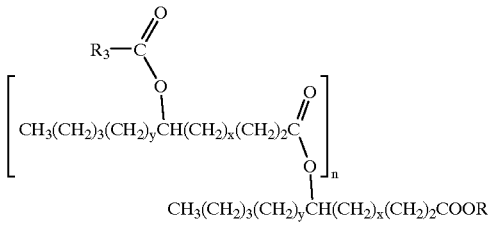

wherein x and y are each equal to 1 or greater than 1;

wherein x+y=10;

wherein n is 0, 1, or greater than 1;

wherein R is $CHR_1R_2$;

wherein $R_1$ and $R_2$ are independently selected from hydrogen and C-1 to C-36 hydrocarbon which may be saturated or unsaturated, branched or straight chain, and substituted or unsubstituted;

wherein $R_3$ is a residual fragment of oleic, myristic, lauric, decanoic, octanoic, or caproic acid;

wherein the predominant species of secondary ester linkage is at the 9 or 10 position; that in, wherein x=5 or 6 and y=5 or 4, respectively; and wherein each of x, y, R, $R_3$ and the value of n are independently selected for each of the estolide compounds within the mixture and $R_3$ is represented in said mixture by at least two of said residual fragments; and (2) an effective amount of a lubricating agent.

20. The lubricant composition of claim 19, wherein the predominant $R_3$ moiety is a residual fragment of lauric acid.

21. The lubricant composition of claim 20, wherein the $R_3$ moieties also include residual fragments of myristic, decanoic, octanoic, caproic and oleic acids.

22. The lubricant composition of claim 19, wherein the $R_3$ moieties are represented by the residual fragments of the fatty acids derived from coconut oil.

23. The lubricant composition of claim 19, wherein the $R_3$ moieties are represented by the residual fragments of the fatty acids derived from palm kernel oil.

24. The lubricant composition of claim 19, wherein the $R_3$ moieties are represented by the residual fragments of the fatty acids derived from cuphea oil.

25. The lubricant composition of claim 19, wherein $R_3$ for at least about 45% of the estolide compounds is a residual fragment of myristic, lauric, decanoic, octanoic, or caproic acid.

26. The lubricant composition of claim 19, wherein $R_3$ for 50–85% of the estolide compounds is a residual fragment of myristic, lauric, decanoic, octanoic, or caproic acid.

27. The lubricant composition of claim 19, wherein R is 2-ethylhexyl.

* * * * *